United States Patent [19]

Miyachi

[11] Patent Number: 4,864,997

[45] Date of Patent: Sep. 12, 1989

[54] AIR-FUEL RATIO CONTROL SYSTEM FOR AN AUTOMOTIVE ENGINE

[75] Inventor: Yoshihiko Miyachi, Hachiohji, Japan

[73] Assignee: Fuji Jukogyo Kabushiki Kaisha, Tokyo, Japan

[21] Appl. No.: 233,027

[22] Filed: Aug. 16, 1988

[30] Foreign Application Priority Data

Aug. 29, 1987 [JP] Japan ..... 62-217077

[51] Int. Cl.[4] ..... F02D 41/08; F02D 41/16

[52] U.S. Cl. ..... 123/489; 123/339

[58] Field of Search ..... 123/339, 440, 489

[56] References Cited

U.S. PATENT DOCUMENTS 4,444,168 4/1984 Matsumura et al. ..... 123/339
4,602,601 7/1986 Kanai ..... 123/489 X
4,805,578 2/1989 Kikuchi et al. ..... 123/489

FOREIGN PATENT DOCUMENTS 60-50246 3/1985 Japan .

*Primary Examiner*—Tony M. Argenbright
*Attorney, Agent, or Firm*—Martin A. Farber

[57] ABSTRACT

An air-fuel ratio control system for idling operation of an automotive engine has an $O_2$-sensor for detecting oxygen concentration of exhaust gas and for producing a feedback signal, a feedback control system responsive to the feedback signal for controlling air-fuel ratio to a desired air-fuel ratio. An idle switch is provided for detecting idling operation of the engine and for producing an idle signal. A lookup table stores a learning coefficient for controlling an actual injection pulse width during idling of the engine. In response to the idle signal the learning coefficient in the lookup table is updated with a new learning coefficient. When a predetermined learning operation is completed, the operation of the feedback control system is interrupted.

2 Claims, 6 Drawing Sheets

AIR-FUEL RATIO CONTROL SYSTEM FOR AN AUTOMOTIVE ENGINE

BACKGROUND OF THE INVENTION

The present invention relates to an air-fuel ratio control system for an automotive engine, and more particularly to a system having an electronic fuel injection system controlled by a learning system.

In one type of electronic fuel-injection control, the quantity of fuel to be injected into the engine is determined in accordance with engine operating variables such as mass air flow, intake-air pressure, engine load and engine speed. The quantity of fuel is determined by a fuel injector energization time (injection pulse width).

Generally, a desired injection amount is obtained by correcting a basic quantity of injection with various correction or compensation coefficients of engine operating variables. The basic injection pulse width $T_P$ is expressed, for example, as follows.

$$T_P = K \times Q/N$$

where Q is mass air flow, N is engine speed and K is a constant.

Desired injection pulse width $T_i$ is obtained by correcting the basic injection pulse $T_P$ with coefficients for engine operating variables. The following is an example of an equation for computing the actual injection pulse width.

$$T_i = T_p x \lambda (Ka \times COEF + K_{ACC} - K_{DC})$$

where COEF is a miscellaneous coefficient comprising various correction or compensation coefficients obtained from memories dependent on coolant temperature and throttle position, λ is a feedback correcting coefficient which is obtained from output signal of an $O_2$-sensor provided in an exhaust passage, and Ka is a correcting coefficient by learning (hereinafter called learning coefficient) for compensating the change of characteristics of devices with time in the fuel control system such as, injectors, and air flow meter employing hot wire, due to deterioration thereof, $K_{ACC}$ is an acceleration correction coefficient and $K_{DC}$ is a deceleration correction coefficient. The coefficients COEF, K, Ka, $K_{ACC}$ and $K_{DC}$ are stored in lookup tables and derived from the tables in accordance with sensed informations. The learning is executed in steady states of the engine operation. In order to detect the steady state, an operation matrix comprising a plurality of divisions is provided. The column and row of the matrix represent engine operating conditions such as engine speed N and basic injection pulse width $T_P$. When the engine operating conditions, continue for a period of time within one of divisions, it is determined that the engine is in a steady state. In such a steady state, the learning operation is executed In the learning, the learning coefficient Ka corresponding to the engine operating conditions is rewritten with a new coefficient Ka*. The new coefficient Ka* is calculated by the following equation.

$$Ka^* = Ka + M \times \Delta LMD$$

where ΔLMD is a difference between an arithmetic average of maximum and minimum values in the output of $O_2$-sensor and a desired value in feedback control as a reference value, and M is a constant.

The learning is started when the output of the $O_2$-sensor changes cyclically, over a reference value for dividing a rich side and lean side, a predetermined number of times (three times) while the engine operating conditions stay in one of the divisions in the matrix.

During the idling of the engine, a short fuel injection pulse width is applied to the injectors so that a little change in the intake air flow causes a relatively large change in the pulse width. As a result, the air-fuel ratio changes largely. Accordingly, when the feedback control is carried out in the idling, the engine idling speed becomes irregular.

In addition, since the temperature of the engine decreases at idling, the output voltage of the $O_2$-sensor becomes low so that the amplitude thereof decreases. Therefore, a definite reference value can not be provided so that decision whether the air fuel is rich or lean becomes inaccurate. Thus, it is preferable to stop the feedback control during the idling.

On the other hand, during the steady state in idling, the learning operation is automatically executed. But the learning must be performed during the feedback control, because the feedback signal is used for the learning.

In order to meet such a requirement, Japanese Patent Laid Open 60-50246 discloses an air-fuel ratio control system where the feedback control is interrupted and the feedback correcting coefficient is held to a set value after the learning operation at the beginning of the idling state.

The interruption of the feedback control is performed only when the engine is in a steady state, and when the engine operating conditions stay in one of the divisions, for example the division of $N_2$-$N_3$/$T_{P1}$-$T_{P2}$ of an operation matrix shown in FIG. *6a*. However, when the altitude at which the vehicle is driven changes thereby changing the atmospheric density, or when an air-conditioner is used thereby increasing the engine load, the basic fuel injection pulse width $T_P$ varies. Therefore, the engine operating conditions may fluctuate in adjacent two division over the border line between the divisions as shown in FIG. *6b*. Such a state cannot be detected as a steady state although it actually is. Accordingly, the feedback control is not stopped so that engine idle speed becomes irregular. In addition, the air-fuel ratio becomes overlean as a result of the drop of the output voltage of the $O_2$-sensor. Thus, engine idle speed is largely deviated from a desired engine speed. In order to detect that the engine is in a steady state under such conditions, the range of the divisions in the matrix must be enlarged. However, the learning dependent on such a large division causes aggravation of the air-fuel ratio control.

SUMMARY OF THE INVENTION

The object of the present invention is to provide an air-fuel ratio control system wherein the air-fuel ratio is controlled by learning during the idling of the engine so as to obtain a stable engine idle speed.

According to the present invention, there is provided an air-fuel ratio control system for idling operation of an automotive engine, having an $O_2$-sensor for detecting oxygen concentration of exhaust gas and for producing a feedback signal, detector means for detecting engine operating conditions and for producing engine operating condition signals, first means responsive to the engine operating condition signals for producing a desired air-fuel ratio signal, feedback control means responsive to the feedback signal for controlling air-fuel ratio to the desired air-fuel ratio dependent on the desired air-fuel ratio signal, and idle detector means for detecting the idling operation and for producing an idle signal.

The system comprises a lookup table storing at least one learning coefficient for controlling an actual injection pulse width during idling of the engine, second means responsive to the feedback signal for producing a new learning coefficient, updating means responsive to the idle signal for updating the learning coefficient in the lookup table with the new learning coefficient, third means for interrupting the operation of the feedback control means when a predetermined learning operation is completed.

In an aspect of the invention, the detector means includes an engine speed detector for producing an engine speed signal, the updating is performed when the engine speed represented by the engine speed signal is lower than a predetermined speed.

The other objects and features of this invention will become understood from the following description with reference to the accompanying drawings.

DETAILED DESCRIPTION OF THE PREFERRED EMBODIMENT

Figure 1:
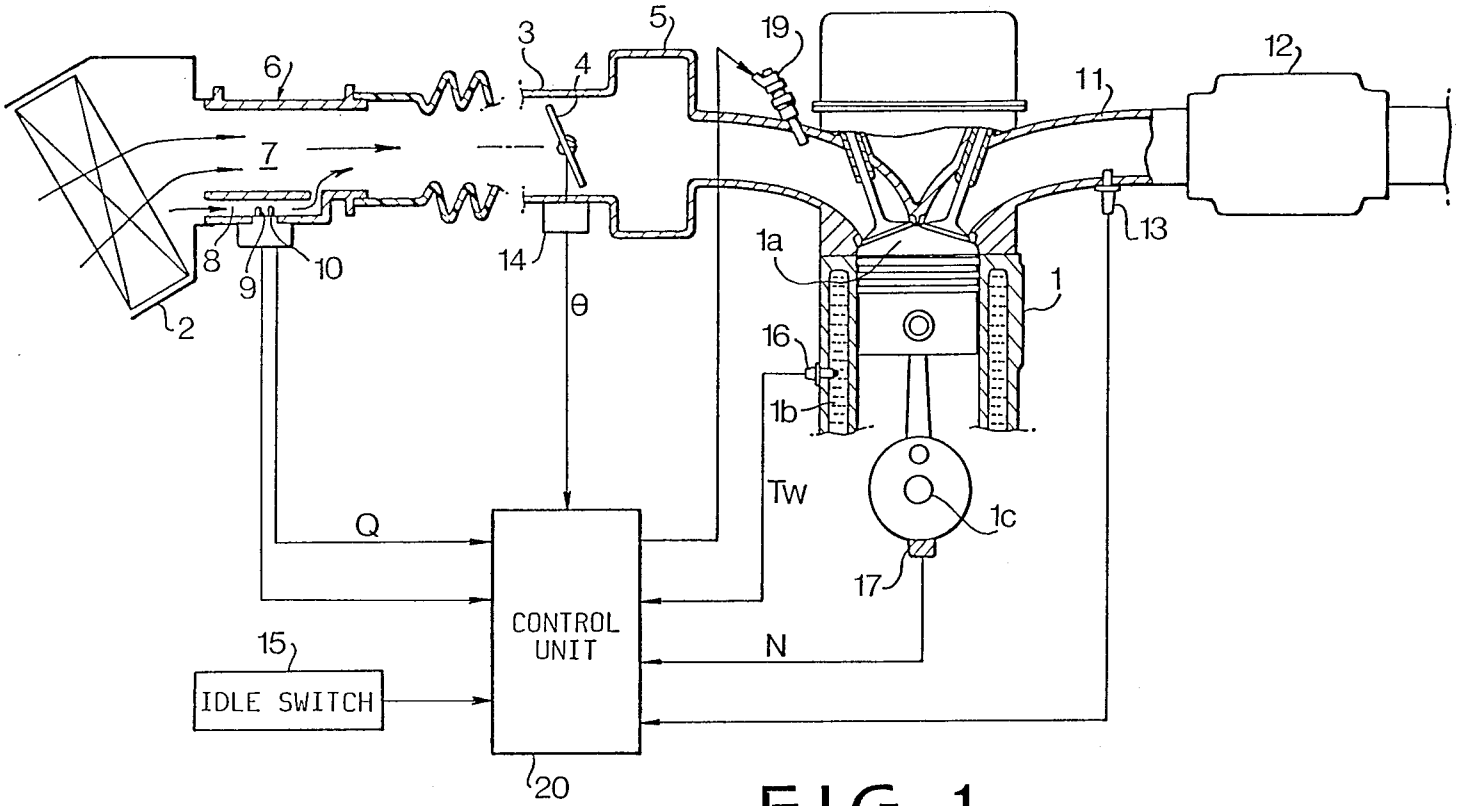
FIG. 1 is a schematic illustration showing a fuel injection system for an automotive engine according to the present invention.

Referring to FIG. 1, a combustion chamber 1*a* of an internal combustion engine 1 for mounted on a vehicle is supplied with air, passing through an air cleaner 2, an intake pipe 3, a throttle valve 4, and a chamber 5 and fuel injected by injectors 19. A mass air flow meter 6 is provided in a bypass 8 at the downstream of the air cleaner 2. The air flow meter 6 comprises a hot wire 9 and a cold wire 10 for detecting the quantity of intake air in the intake pipe 3. An output signal of the air flow meter 6 is supplied to an electronic control unit 20 comprising a microcomputer. An $O_2$-sensor 13 and a catalytic converter 12 are provided in an exhaust passage 11. A throttle position sensor 14 is provided adjacent the throttle valve 4 for producing a throttle position signal $\theta$. A coolant temperature sensor 16 is provided on a water jacket 1*b* of the engine 1 for producing a temperature signal Tw. A crank angle sensor 17 is mounted on a crankshaft 1*c* of the engine 1 for detecting engine speed. An idle switch 15 which is turned on during the idling of the engine is further provided. Output signals from these sensors 13, 14, 16 and 17 are supplied to the control unit 20. The control unit 20 determines a pulse width for fuel injected from the injectors 19 by a pump (not shown).

Figure 2:
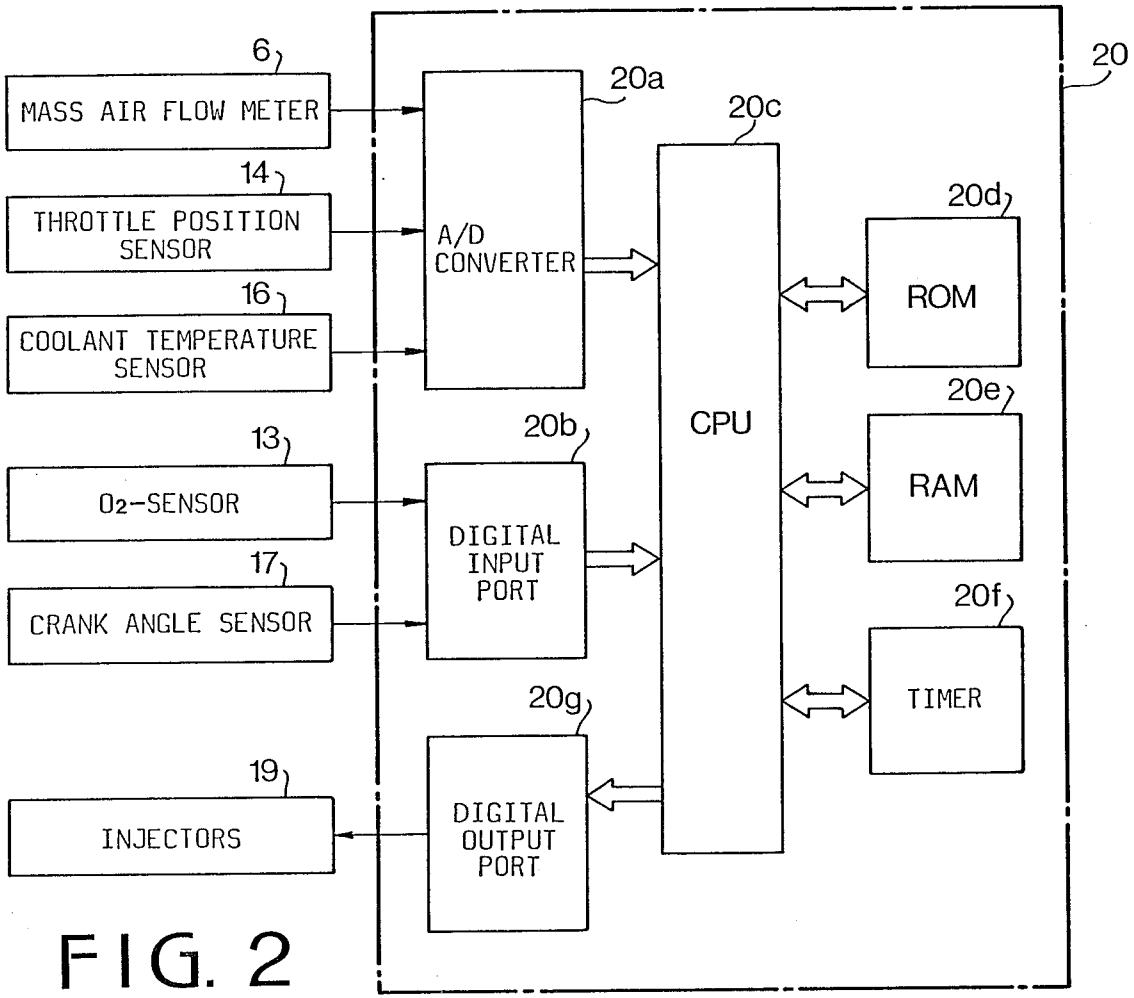
FIG. 2 is a block diagram of the control system of the present invention.

Referring to FIG. 2, the control unit 20 comprises a central processor unit (CPU) 20*c*, a read only memory (ROM) 20*d*, and a random access memory (RAM) 20*e*. The CPU 20*c*, ROM 20*d*, and RAM 20*e* are connected to each other through bus lines. An A/D converter 20*a* and a digital input port 20*b* are connected to the CPU 20*c* through bus lines. The A/D converter 20*a* is supplied with analog voltage signals from the air flow meter 6, throttle position sensor 14 and coolant temperature sensor 16 to convert the analog voltage signals into a digital signals The digital input port 20*b* is applied with output signals from the $O_2$-sensor 13 and crank angle sensor 17. An output signal of the CPU 20*c* is supplied to a digital output port 20*g*, thereby producing a pulse signal for driving the injectors 19. A timer 20*f* connected to the CPU 20*c* through a bus line is provided for timing the control operation in the CPU 20*c*.

Figure 3:
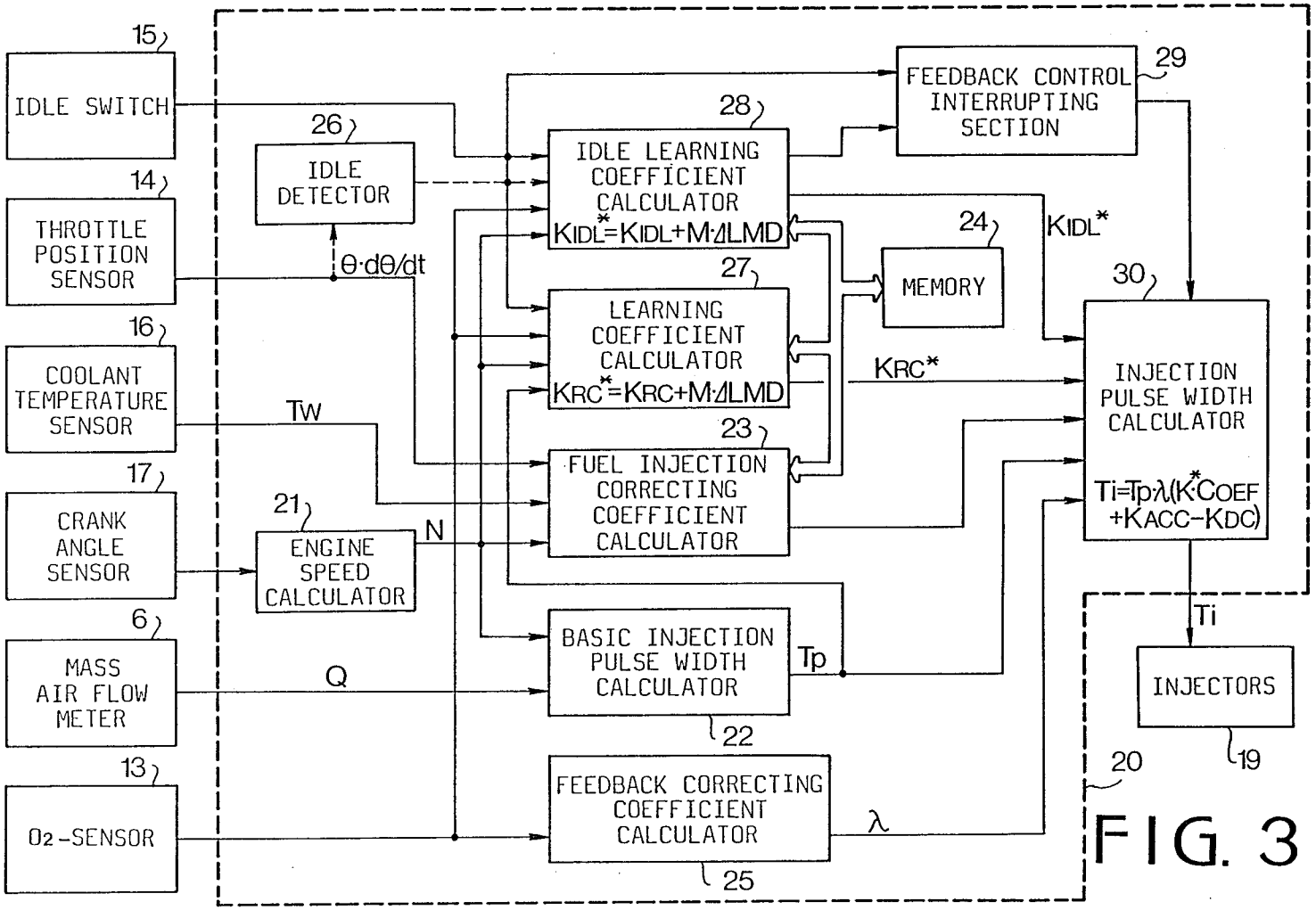
FIG. 3 is a block diagram showing functional sections in the control system.

Referring to FIG. 3, the control unit 20 has an engine speed calculator 21 to which a pulse signal of the crank angle sensor 17 is applied to calculate the engine speed N. The engine speed N is applied to a basic fuel injection pulse width calculator 22 which is supplied with a signal representing intake air quantity Q at the air flow meter 6 for calculating a basic injection pulse width $T_P$ in dependence on $T_P = K \times Q/N$.

In a fuel injection correcting coefficient calculator 23, a miscellaneous correcting coefficient COEF, acceleration correction coefficient $K_{ACC}$ and deceleration correction coefficient $K_{DC}$ stored in a memory 24 are derived in accordance with the engine speed N, throttle position $\theta$ detected by the throttle position sensor 14, a changing rate $d\theta/dt$ of the throttle position $\theta$, and a coolant temperature Tw. A feedback correcting coefficient calculator 25 is provided for calculating a feedback correcting coefficient $\lambda$ obtained from a proportional and an integral of the output voltage of the $O_2$-sensor 13.

Output signals of the engine speed calculator 21, the basic fuel injection pulse width calculator 22, the $O_2$-sensor 13 and the idle switch 15 are applied to a learning coefficient calculator 27. On the other hand, an idle learning coefficient calculator 28 is provided and supplied with outputs of idle switch 15, engine speed calculator 21 and $O_2$-sensor 13. The learning coefficient calculators 27 and 28 are connected to a memory 24 storing learning coefficients by a bus line. The memory 24 has a two-dimensional lookup table storing a plurality of learning coefficients $K_{RC}$ and a single learning coefficient $K_{IDL}$ for idling. The learning coefficient calculator 27 calculates an arithmetical average LMD of maximum value A and minimum value B in the output of the $O_2$-sensor 13 and calculates a new learning coefficient $K_{RC}^*$ by the following equation.

$$K_{RC}^* = K_{RC} + M \times \Delta LMD$$

where $\Delta$ LMD is a difference of the LMD from a desired value ($\lambda = 1$) in the feedback control, as a reference value and M is a constant.

Further, the calculator 27 detects a corresponding division in accordance with engine speed N and basic injection pulse width $T_P$ and updates the coefficient $K_{RC}$ in the detected division with the new coefficient $K_{RC}^*$ under predetermined conditions such as, (1) the coolant temperature Tw exceeds a predetermined reference value, (2) the feedback control is performed, and (3) the engine is in a steady state where engine operation continues during a predetermined period, that is, the output signal of the $O_2$-sensor 13 has changed cyclically over the reference value to rich and lean sides during predetermined times $NL_{RC}$ within one of the divisions of the operation matrix.

The idle learning coefficient calculator 28 is connected to the single memory unit of the learning coefficient table for idling state in the memory 24. When the idle switch 15 is on, the calculator 27 derives the idle coefficient $K_{IDL}$ from the table and calculate a new coefficient $K_{IDL}$* by the following equation.

$$K_{IDL}^{*}=K_{IDL}+M \times \Delta LMD$$

Thus, the coefficient $K_{IDL}$ is updated by the new coefficient $K_{IDL}$*.

An injection pulse width calculator 30 calculates the desired injection pulse width $T_i$ based on the outputs of the calculators 22, 23, 25 and 27 or 28 in accordance with the following equation.

$$T_i=T_p \times \lambda(K^* \times COEF+K_{ACC}-K_{DC})$$

where K* represents the learning coefficient $K_{RC}$ or the idle learning coefficient $K_{IDL}$ depending on whether the engine is in an ordinary operating state or in idling state. The pulse width $T_i$ is supplied to the injectors 19.

In accordance with the present invention, a feedback control interrupting section 29 is provided for applying an interrupting signal to the injection pulse width calculator 30 in dependence on the signals from the idle switch 15 and idle learning coefficient calculator 28. When the updating of the idle learning coefficient is performed a predetermined number of times $NL_{IDL}$ after the idle switch 15 is turned on, the interrupting section 29 produces the interrupting signal, so that the feedback control is interrupted. During the interruption, the desired fuel injection pulse width $T_i$ is calculated with a fixed feedback coefficient λ. The last updated learning coefficient $K_{IDL}$ is used as a learning coefficient. Since the feedback control is no longer carried out, the conditions for the learning control is not fulfilled so that learning control is not executed.

The idling state of the engine can be detected by other means beside idle switch. For example, as shown by dotted lines in FIG. 3, an idle detector 26 may be provided in the control unit 20 so as to generate an idle signal in dependence on the throttle opening degree detected by the throttle position sensor 14.

The operation of the control system will be described hereinafter with reference to FIGS. 4 and 5.

Figure 4:
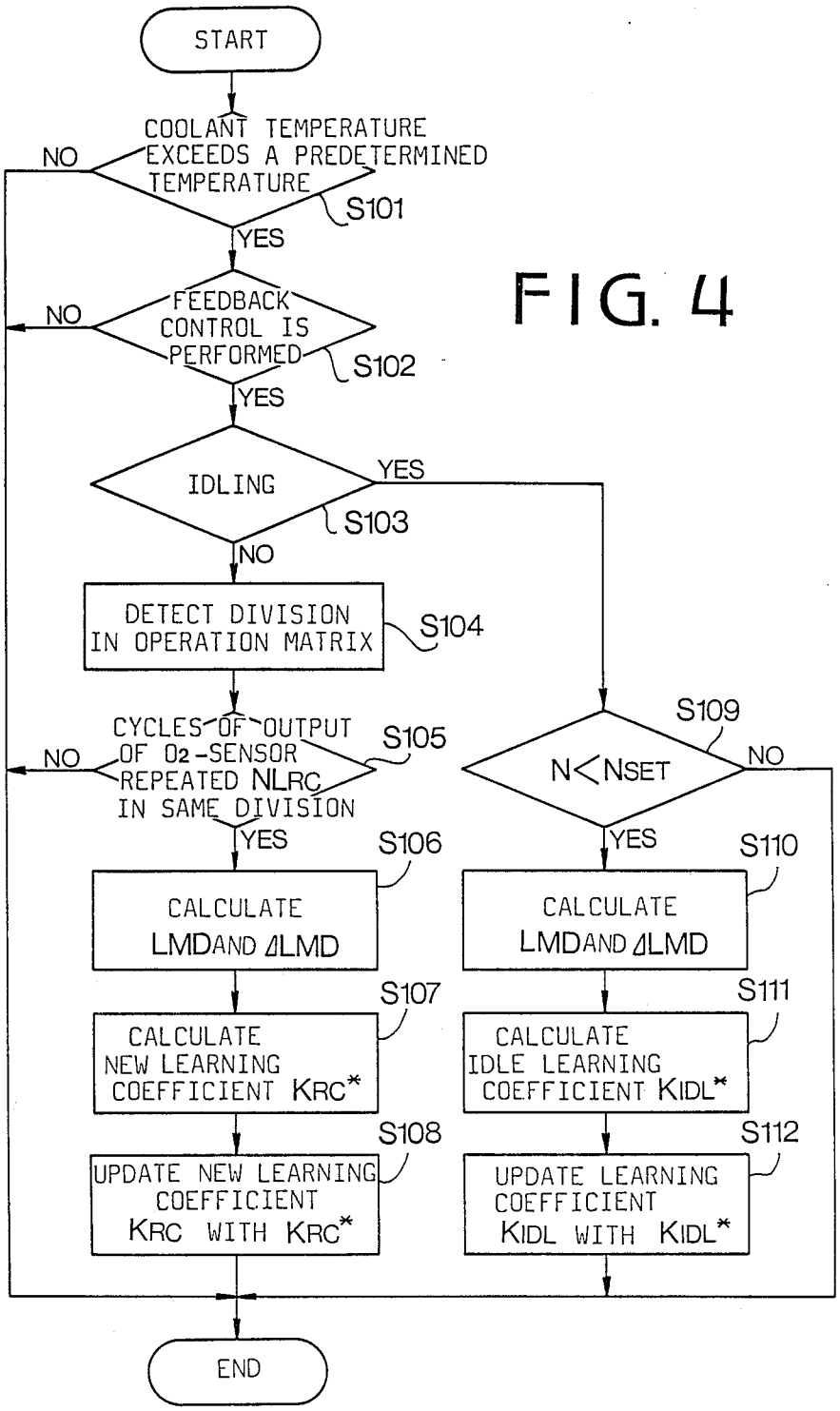
FIGS. 4 and 5 are flow charts showing the operation of the system.

Referring to FIG. 4 showing a subroutine for the learning operation, it is determined for starting the learning, at a step S101 whether the coolant temperature Tw exceeds a predetermined temperature and whether the air-fuel ratio feedback control is performed at a step S102. If the engine is under both conditions, the program proceeds to a step S103 where idling is determined.

When the engine is not idling but is in ordinary operating condition, the program proceeds to a step S104 where a division in the operation matrix in which the detected engine operating conditions reside is detected. At a step S105, it is determined whether the numbers of the cycles of the output signal of the $O_2$-sensor, while the engine operating conditions stay in the same division detected at the step S104, is larger than the predetermined number $NL_{RC}$. When the number exceeds the number $NL_{RC}$, the arithmetical average LMD of the output voltage of the $O_2$-sensor 13 and the difference ΔLMD between the average LMD and the desired value are calculated. At a step 107, the new learning coefficient $K_{RC}$* is calculated and the learning coefficient $K_{RC}$ at a corresponding address is updated with the new coefficient $K_{RC}$* at a step S108.

If the idling state is determined at the step S103, the program proceeds to a step S109 where the engine speed N is compared with a predetermined speed $N_{SET}$. When the engine speed N is higher than the speed $N_{SET}$, it means that the vehicle speed is decelerating while coasting at the release of the accelerator pedal in the non-load state. Under the condition, other measures for decelerating the engine speed, such as fuel cutoff are taken so that the air-fuel ratio is greatly deviated from the initial value. If the learning operation is performed in such a state, the learning coefficient derived from the table is not appropriate for the driving condition. Therefore, the learning should not be performed and the program is terminated.

When it is determined that the engine speed N is lower than the set speed $N_{SET}$ at the step S109, the average LMD and the difference Δ LMD are calculated at the step S110 in the same manner as at the step S106. The idle learning coefficient $K_{IDL}$* is calculated at a step S111. The single learning coefficient $K_{IDL}$ in the table is updated with $K_{IDL}$* at a step S112.

Figure 5:
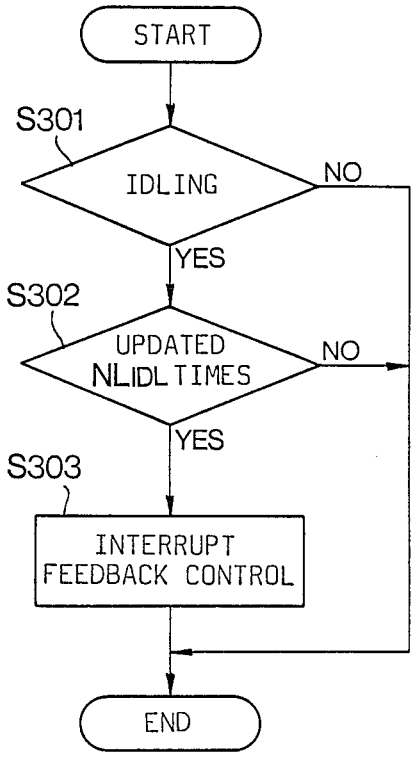
Figure 6A:
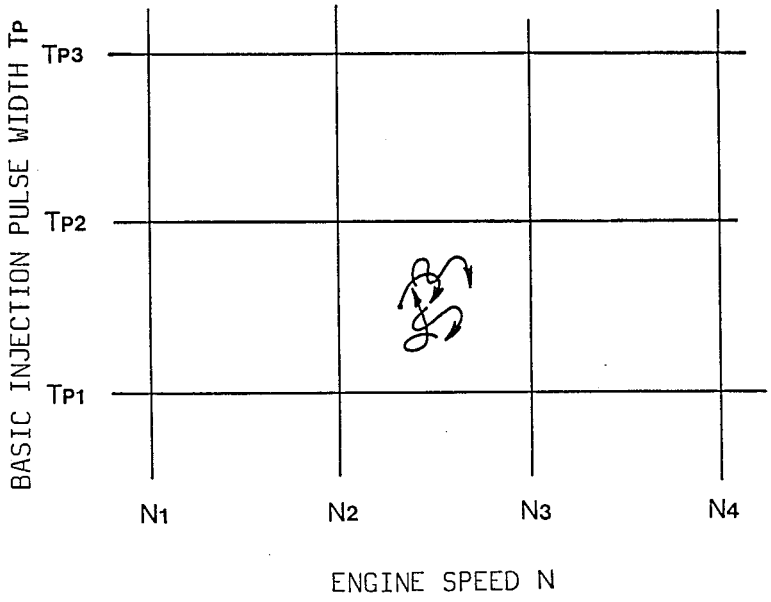
FIGS. 6*a* and 6*b* are operation matrixes for detecting steady states of an engine.
Figure 6B:
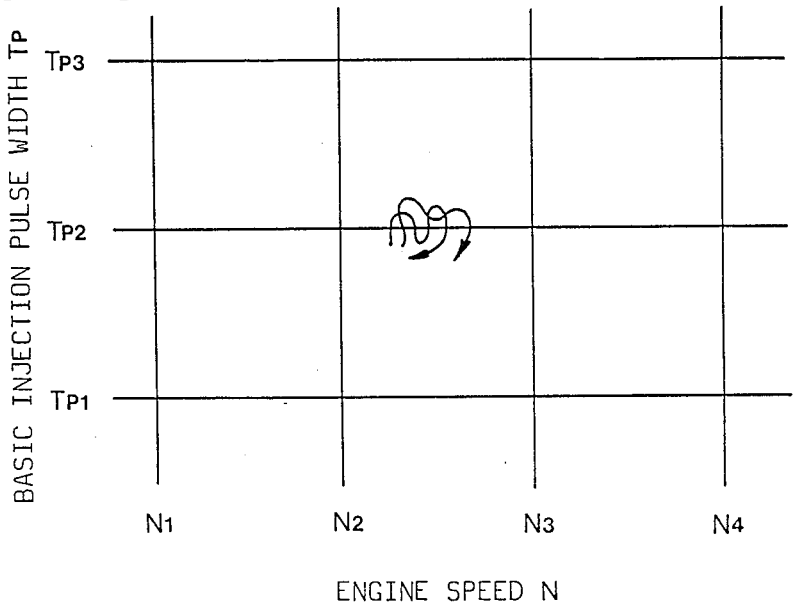

Referring to FIG. 5 showing a subroutine for stopping the feedback control at idling, at a step S301, it is determined whether the engine is idling or not. When the engine is 20 idling, it is further determined whether the updating times of the idle learning coefficient $K_{IDL}$ is more than the predetermined number of times $NL_{IDL}$. Even if a new coefficient $K_{IDL}$* is the same as the old coefficient $K_{IDL}$, the rewrite operation is performed. When the idle learning coefficient $K_{IDL}$ is rewritten more than $NL_{IDL}$ times, the program proceeds to a step S303 where feedback control of the air-fuel ratio is interrupted. Therefore, in the subroutine shown in FIG. 4, since the condition for learning of the coefficient at step S102 is not fulfilled, the idle learning coefficient $K_{IDL}$ is not updated. Accordingly, the coefficient $K_{IDL}$ is held at the value of the latest calculated coefficient $K_{IDL}$*. Thus, the fuel injection pulse width $T_i$ is calculated dependent on the basic fuel injection pulse width $T_p$, miscellaneous coefficient COEF, acceleration correction coefficient $K_{ACC}$, deceleration correction coefficient $K_{DC}$ and the latest idle learning coefficient $K_{IDL}$*.

In accordance with the control system of the present invention, the learning of the correction coefficient at idling is performed without determining a division in the operation matrix. Therefore, if atmospheric density varies as a result of the change in external driving conditions such as altitude and temperature, or the change of engine load and hence intake air quantity varies, such as the operation of the air-conditioner during idling, the feedback control is necessarily interrupted after the learning of the correction coefficient. Accordingly, irregular engine idle speed is prevented.

While the presently preferred embodiment of the present invention has been shown and described, it is to be understood that this disclosure is for the purpose of illustration and that various changes and modifications may be made without departing from scope of the invention as set forth in the appended claims.

What is claimed is:

1. An air-fuel ratio control system for idling operation of an automotive engine, having an $O_2$-sensor for detecting oxygen concentration of exhaust gas and for producing a feedback signal, detector means for detecting engine operating conditions and for producing engine operating condition signals, first means responsive to the engine operating condition signals for producing a desired air-fuel ratio signal, feedback control means responsive to the feedback signal for controlling air-fuel ratio to the desired air-fuel ratio dependent of the desired air-fuel ratio signal, and idle detector means for detecting the idling operation and for producing an idle signal, the system comprising:

memorizing means for storing at least one learning coefficient for controlling an actual injection pulse width during idling of the engine;

second means responsive to the feedback signal for producing a new learning coefficient;

updating means responsive to the idle signal for updating the learning coefficient in the lookup table with the new learning coefficient;

third means for interrupting the operation of the feedback control means when a predetermined learning operation is completed.

2. The system according to claim 1 wherein the detector means includes an engine speed detector for producing an engine speed signal, the updating is performed when the engine speed represented by the engine speed signal is lower than a predetermined speed.

* * * * *